US007418216B2

(12) United States Patent
Elliot et al.

(10) Patent No.: US 7,418,216 B2
(45) Date of Patent: Aug. 26, 2008

(54) SYSTEM FOR PREDICTING ERASURE OF TEST PATCHES IN A PRINTING APPARATUS

(75) Inventors: Michael W. Elliot, Penfield, NY (US); Stephen F. Randall, West Henrietta, NY (US); Michael J. Dahrea, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 233 days.

(21) Appl. No.: 11/516,898

(22) Filed: Sep. 7, 2006

(65) Prior Publication Data

US 2008/0063417 A1 Mar. 13, 2008

(51) Int. Cl.
*G03G 15/00* (2006.01)

(52) U.S. Cl. ..... 399/49; 399/72

(58) Field of Classification Search ..... 399/38, 399/46, 49, 72

See application file for complete search history.

(56) References Cited

U.S. PATENT DOCUMENTS

| | | | | |
|---|---|---|---|---|
| 5,504,568 | A | 4/1996 | Saraswat et al. | |
| 6,167,217 | A | 12/2000 | Kelsch et al. | |
| 6,385,408 | B1 | 5/2002 | Scheuer | |
| 6,404,997 | B1 * | 6/2002 | Grace | 399/27 |
| 6,842,590 | B2 * | 1/2005 | Dalal et al. | 399/49 |

FOREIGN PATENT DOCUMENTS

JP 2007-232837 * 9/2007

* cited by examiner

*Primary Examiner*—Hoan H Tran
(74) *Attorney, Agent, or Firm*—R. Hutter

(57) ABSTRACT

In a printing apparatus having a rotatable imaging member, a test patch is created in a predetermined area of the imaging member. A density of the test patch is measured at least a first time, corresponding to a first rotation of the imaging member. Based at least partially on the measuring of the density of the test patch at least a first time, how many rotations in the future the predetermined area of the imaging member will be available for receiving new marking material is predicted.

15 Claims, 3 Drawing Sheets

SYSTEM FOR PREDICTING ERASURE OF TEST PATCHES IN A PRINTING APPARATUS

CROSS-REFERENCE TO RELATED APPLICATION

The following patent applications are being filed simultaneously herewith: SCHEDULING SYSTEM FOR PLACING TEST PATCHES IN A PRINTING APPARATUS, U.S. patent application Ser. No. 11/517,163, Michael W. Elliot, et al; and SCHEDULING SYSTEM FOR PLACING TEST PATCHES OF VARIOUS TYPES IN A PRINTING APPARATUS, U.S. patent application Ser. No. 11/516,838, Bejan M. Shemirani, et al.

TECHNICAL FIELD

The present disclosure relates to digital printing systems, such as those using xerography.

BACKGROUND

Many printing technologies, such as xerography and ink-jet printing, exploit a rotatable imaging member on which an image is first created with marking material, such as liquid ink or powdered toner, and then transferred to a print sheet. When controlling such a printing apparatus, it is common to place on the imaging member at various times "test patches," meaning areas of marking material of predetermined desired properties such as optical density, and then measuring the actual properties of each test patch as part of an overall control process.

In some embodiments of printing apparatus, the test patches are placed on the imaging member, and tested for certain properties; but the marking material forming each test patch is never transferred to a print sheet. In such cases, the marking material forming the test patches has to be cleaned off, such as by a cleaning device within the apparatus. In some situations, the imaging member has to cycle multiple times past the cleaning device to remove the marking material sufficiently from the patch area. On the intermediate cycles before the marking material on the test patch is completely removed, the area around the test patch cannot be used for placing of images.

U.S. Pat. Nos. 6,167,217 and 6,385,408 disclose basic systems for scheduling the creation of test patches in a xerographic printer. U.S. Pat. No. 5,504,568 discloses a system in which images to be submitted to a printer a short time in the future are taken into consideration for purposes of scheduling two-sided printing.

SUMMARY

According to one embodiment, there is provided a method of operating a printing apparatus, the apparatus having a rotatable imaging member, an imaging station useful in creating printable images and test patches on the rotatable imaging member, a cleaning station for removing marking material from the imaging member, and a sensor for measuring a density of marking material on a test patch. A test patch is created in a predetermined area of the imaging member. A density of the test patch is measured at least a first time, corresponding to a first rotation of the imaging member. Based at least partially on the measuring of the density of the test patch at least a first time, how many rotations in the future the predetermined area of the imaging member will be available for receiving new marking material is predicted. The predetermined area of the imaging member is re-imaged following the predicted number of rotations.

According to another embodiment, there is provided a method of operating a printing apparatus, the apparatus having a rotatable imaging member, an imaging station useful in creating printable images and test patches on the rotatable imaging member, a cleaning station for removing marking material from the imaging member, and a sensor for measuring a density of marking material on a test patch. A test patch is created in a predetermined area of the imaging member. For a selected type of test patch, a predetermined number of rotations for effectively erasing the test patch are scheduled. A density of the test patch is measured at least a first time, corresponding to a first rotation of the imaging member. Based at least partially on the measuring of the density of the test patch at least a first time, the scheduled number of rotations for effectively erasing the test patch is reduced. The predetermined area of the imaging member is re-imaged following the reduced scheduled number of rotations.

DETAILED DESCRIPTION

Figure 1:
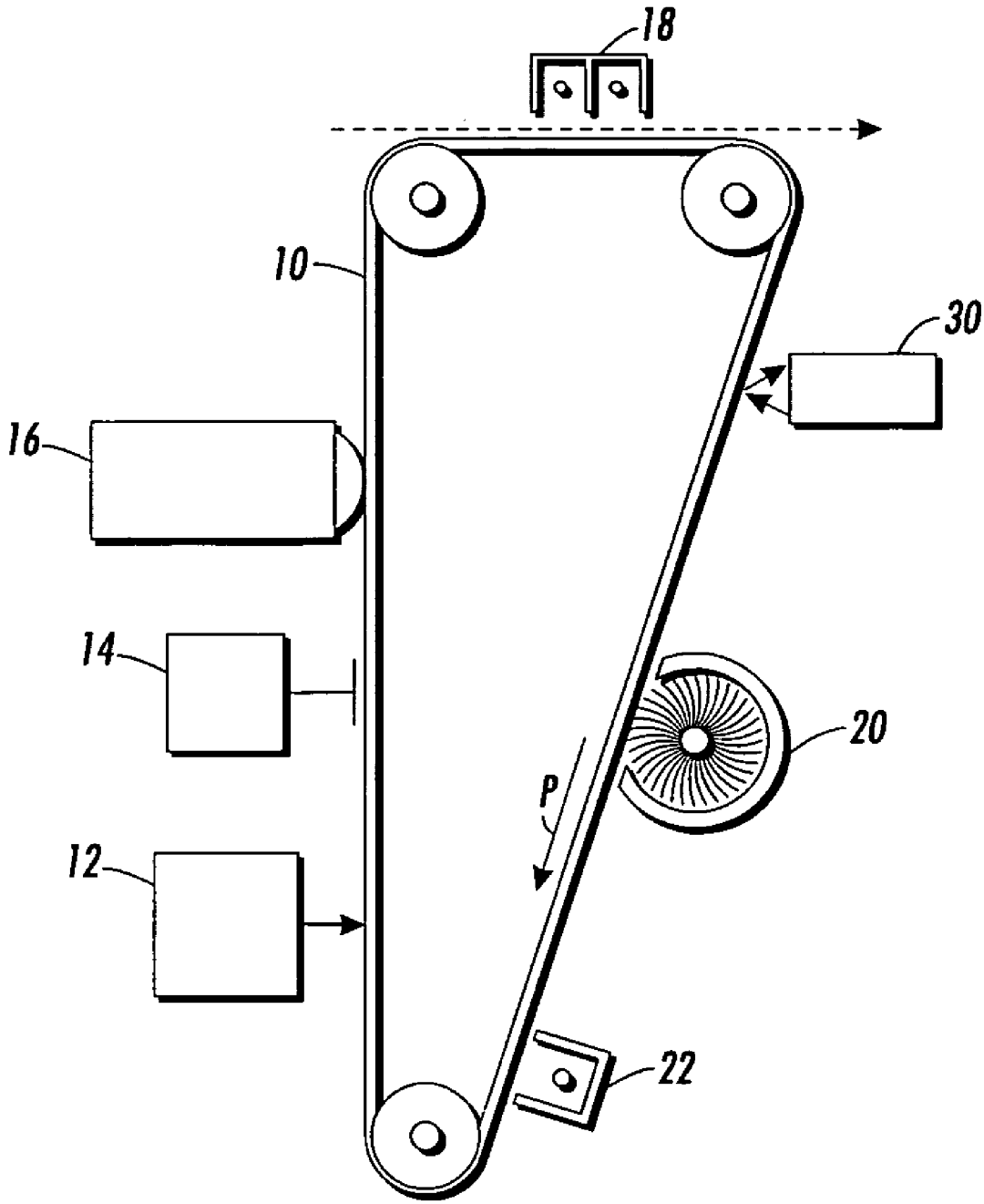
FIG. 1 (PRIOR ART)
FIG. 1 is a simplified elevational view of the basic elements of a xerographic printer.

FIG. 1 is a simplified elevational view of the basic elements of a xerographic "laser" printer, as is generally familiar in the art. Although a monochrome, xerographic printing apparatus with a photoreceptor belt is shown and described in the present embodiment, the claimed invention can be applied to other printing technologies, such as ink-jet or offset, and can be applied to any color apparatus in which multiple color separations are "built up" in one or more cycles on a rotatable image member to form a full-color image.

In the FIG. 1 embodiment, a rotatable imaging member is in the form of a belt photoreceptor 10 (although other types of imaging member are applicable, such as in other printing architectures and technologies). The photoreceptor 10 rotates along a process direction P. With regard to any small area on the outside surface of photoreceptor 10, the area is first initially charged by a charging device 22. An electrostatic latent image, based on an image desired to be printed, is created by using a laser 12 to discharge certain areas of the photoreceptor surface. (Broadly speaking, the laser 12 and its ancillary optical elements form an "imaging station;" other types of imaging station could include an ink-jet printhead, an ionographic printhead, a photoreceptor from which an image is transferred to an intermediate belt, or any other device that causes a desired image or latent image to be placed on the rotatable imaging member.) In certain types of printing systems, the condition of the photoreceptor after image exposure can be monitored by a sensor 14, which is typically in the form of an electrostatic voltmeter or an optically-based sensor. The suitably-charged areas are then developed with developer unit 16, which in this case places toner particles in imagewise fashion on the surface of photoreceptor 10. The toner, or more broadly marking material, is then transferred to a print sheet (not shown) at a transfer station 18. Any residual toner remaining on the photoreceptor 10 after image transfer is cleaned by a cleaning device 20, so that the photoreceptor surface can be recharged at charging station 22 to receive another image.

At times when it desired to place a test patch on the surface of photoreceptor 10, the laser 12 is used to place a latent image on the photoreceptor, such that, when the latent image is developed with developer unit 16, a test patch of desired properties (such as optical density) results. In the FIG. 1 embodiment, the developed test patch is then monitored for density by a test patch monitor 30, seen here downstream of the transfer station 18. As mentioned above, when test patches are deployed, the marking material for the patches is typically not transferred to a print sheet at transfer station 18, and so a relatively large quantity of marking material must be removed by cleaning station 20. In many cases, the photoreceptor 10 must cycle the test patch multiple times (typically two or three times) past cleaning device 20 to remove all the marking material, so that the area can be used for placing an image thereon. Also, it would not be desirable to place a subsequent test patch in the same place as an imperfectly removed previous test patch, as the residual marking material would adversely affect the testing of the new test patch.

Figure 2:
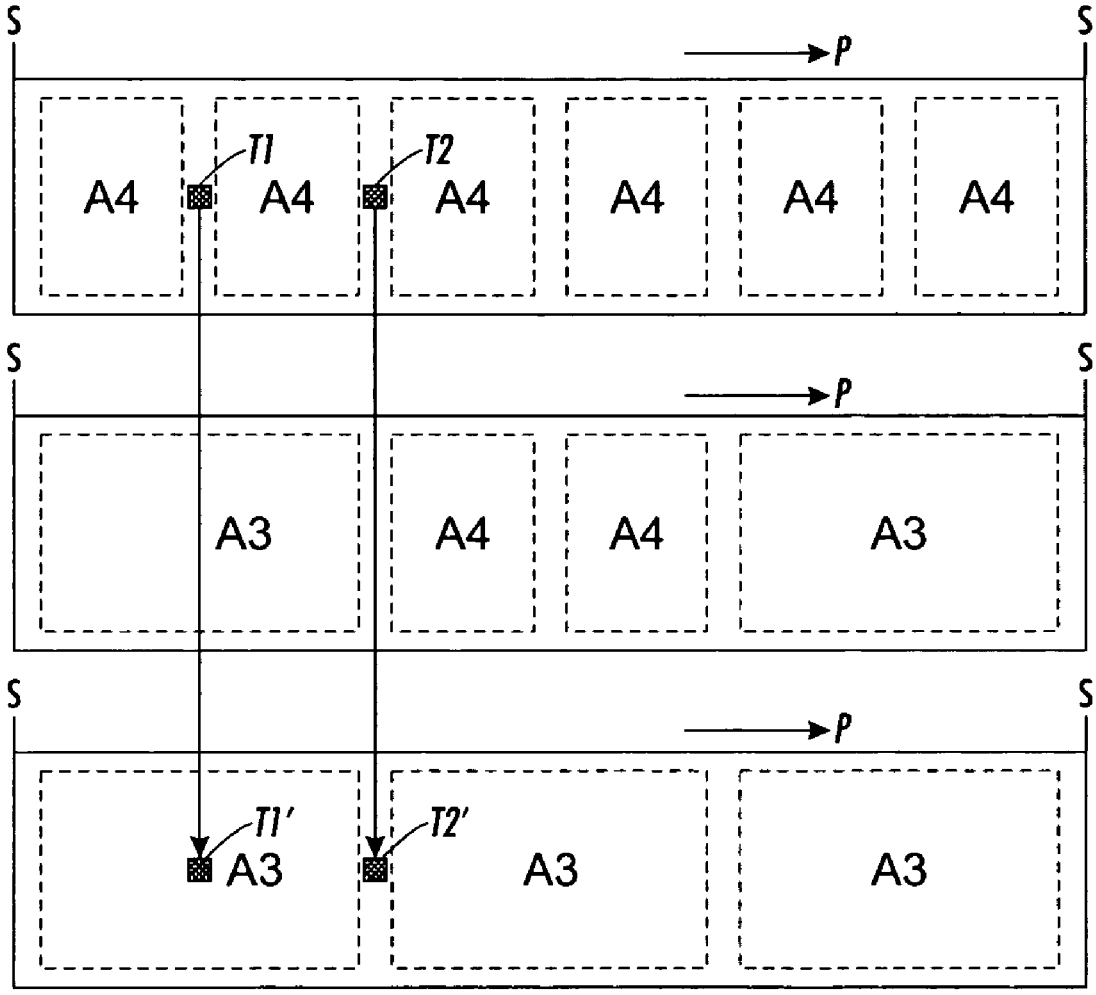
FIG. 2 is a plan view of a belt photoreceptor "flattened out" over three rotations thereof.

FIG. 2 is a plan view of the photoreceptor 10 "flattened out" over three rotations thereof. In the following discussion, it will be assumed that the apparatus is designed to create, as needed, either "one pitch" (letter or A4) or "two pitch" (11×17 inch or A3) images, although other image sizes would be possible in other practical embodiments. As shown, the two ends of the photoreceptor 10 are marked by a seam S, which here is used merely to demarcate separate rotations of the photoreceptor 10. In the embodiment, each rotation of the photoreceptor belt 10 accommodates six one-pitch images, indicated as A4 for convenience; three two-pitch images, indicated as A3 for convenience; or some combination of one-pitch and two-pitch images within each rotation as desired and as physically possible.

Test patches are placed at various locations in "interdocument zones" between image areas, typically some predetermined safe distance from areas where an image would be placed, so that marking material from the test patches would not accidentally be transferred to a print sheet as part of an image to be printed. Taking the example of a test patch T1 placed as shown, and assuming there must be three rotations of photoreceptor 10 before the patch T1 is fully erased, it can be seen that, once the test patch T1 is placed, the area on which the patch has been placed is precluded from receiving an A3 image two rotations in the future, as shown by the patch T1', which is the same patch T1, only two rotations later, and not completely erased. However, a patch such as shown at T2, which two rotations later would be disposed between two A3 image areas, would be allowable. Of course, one way to ascertain whether the placement of a patch at T2 would be allowable is to populate a future time-frame of images to be printed, and see what gaps are available.

The scenario of FIG. 2 presumes that a test patch such as T1 or T2 placed initially on a predetermined area of photoreceptor 10 will "survive" at least two passes through the cleaning station 20 such as shown in FIG. 1. In other words, cleaning station 20 is of such an effectiveness that typically three passes through the cleaning station are required to remove effectively all of a test patch before further marking material, either as part of an image to be printed or another test patch. However, in a practical situation, given various real-world conditions at a given time, all of the marking material associated with a test patch may be removed in fewer than a baseline number of rotations of the patch past cleaning station 20. The sensor 14 and/or test patch monitor 30 can be used for real-time measurement of a patch such as T1, for multiple rotations immediately after the creation of a test patch by laser 12 and developer unit 16. With each rotation of a test patch through cleaning station 20, the erasure of the test patch can thus be monitored as it approaches effective completion and the area can be made available for further imaging.

According to one embodiment, with each passage of a test patch past sensor 14 and/or test patch monitor 30, the successive removal of marking material is monitored, and a "complete erasure point," i.e., a state where there is sufficient confidence that there will be effectively complete removal of the marking material on the next rotation, is predicted. The diminution of marking material in a test patch from some initial amount to effectively zero with repeated passes through cleaning station 20 can follow some largely predictable function; or in some cases the removal of the marking material can be complete with one pass through the cleaning station 20.

The ability to predict that a given small area along the image receptor will be available, in the next rotation of the image receptor, for receiving either an image to be printed or a new test patch is useful for overall efficiency of a system. In designing a control system for a large printer, it is typically assumed that any test patch will require a certain number of rotations past the cleaning station before the area is available for a subsequent test patch. Scheduling algorithms associated with different types of patches are typically obliged to set aside a predetermined number of future rotations of the photoreceptor for erasing the test patch before scheduling further patches or images in the area. If, however, it could be confidently predicted, upon a real-time measurement of the test patch, that fewer than the scheduled number of rotations are required, more opportunities of placing images and/or test patches of various types for various reasons can be provided over time. (One situation in which fewer than a scheduled number of rotations are required would be if the actual density of the original test patch is significantly less than the intended density of the test patch.)

Figure 3:
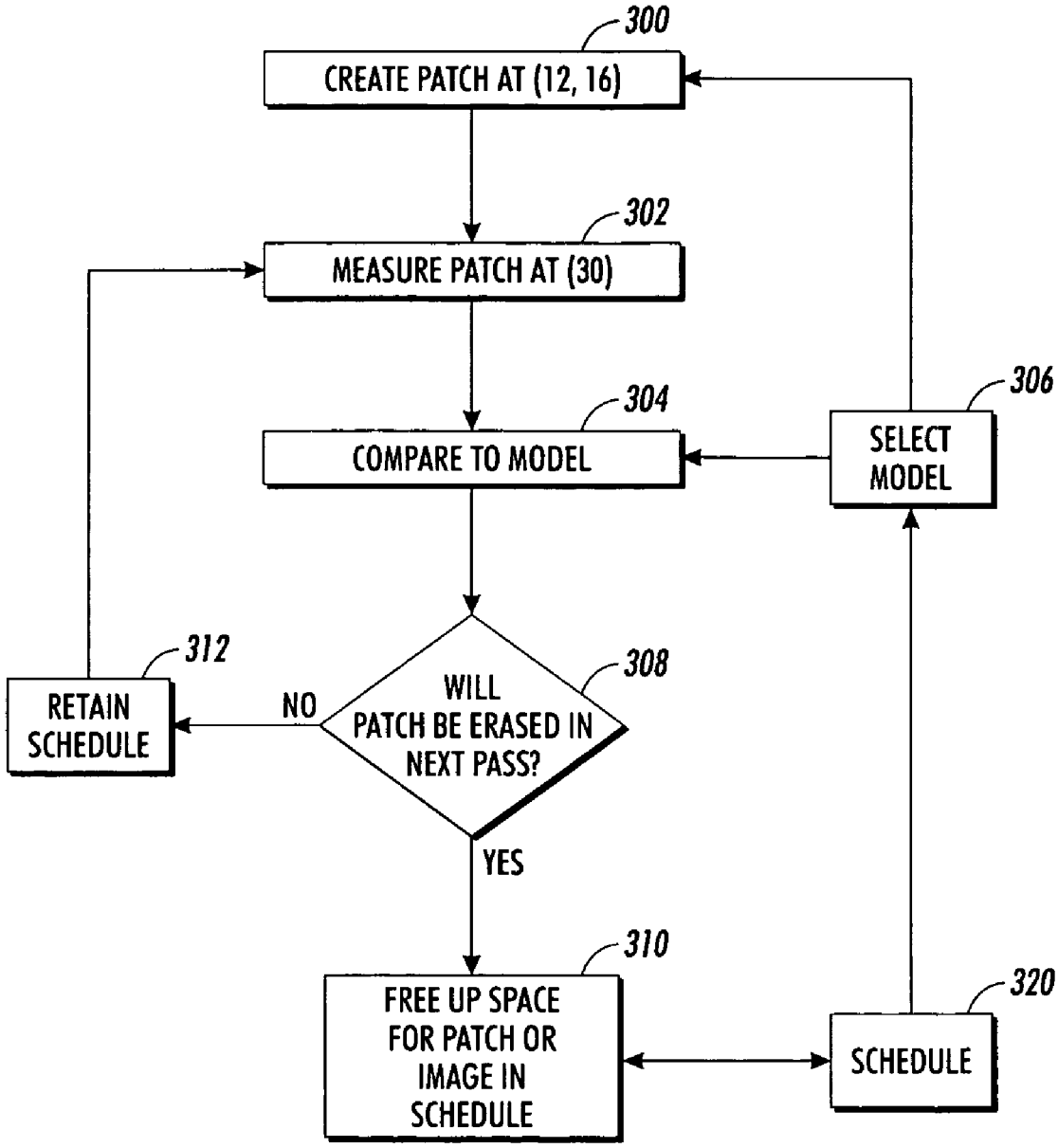
FIG. 3 is a flowchart showing the basic steps, to be undertaken by a control system operative of a printing apparatus.

FIG. 3 is a flowchart showing the basic steps, to be undertaken by a control system operative of a printing apparatus. The method shown in the flowchart interacts with other algorithms for performing tests which include placing test patches on the photoreceptor 10 and then reading the reflectivity thereof, such as with test patch monitor 30. According to the embodiment, at various times a test patch is created by use of laser 12 and development unit 16 (step 300). The created test patch passes through transfer station 18 (test patches are typically not transferred to a print sheet) and then measured in reflectivity by patch monitor 30 (step 302).

The measurement from step 302 is then compared to a target value (step 304), derived from a "model" (step 306) that will be described in detail below. If the measured value of the test patch is consistent with being effectively completely erased by the next pass of the test patch through cleaning station 20 (step 308), then the area occupied by the test patch can be freed up for immediate occupation by an image or subsequent test patch (step 310). If the measured value of the test patch is not consistent with being effectively completely erased by the next pass of the test patch through cleaning station 20, the scheduled occupation of the area before becoming available for re-imaging is retained (step 312), and the photoreceptor 10 is cycled again so that the patch area is cleaned by cleaning station 20 and re-measured by patch monitor 30.

It will be noted, returning briefly to FIG. 1, that if a test patch measured at patch monitor 30 is deemed effectively completely erasable by the next pass of the test patch through cleaning station 20, the area can receive new marking material within the same rotation of photoreceptor 10, yielding extra degrees of freedom for scheduling images or further test patches.

With regard to the "model" selection at step 306, the necessary parameters of any model of patch erasure include: the type (such as color or MICR capability) of the marking material used in the patch; the original intended density of the test patch; and empirical data relating to a maximum density of the test patch just before a possible final pass through the cleaning station 20. The threshold of a maximum density consistent with subsequent "complete" erasure may be a single value, e.g. "if the measured density is less than 1%, then it will be completely erased in the next pass through cleaning station 20;" alternatively, such a determination in some situations may have as inputs a set of points representing a trend, e.g., "if the measured density is less than 2% in a first pass and less than 0.5% in a second pass, then it will be completely erased in the next pass through cleaning station 20, and a third pass will not be necessary." In effect, the model predicts how many rotations in the future the area of the photoreceptor 10 will be available for receiving new marking material. Depending on the measurements at step 302 and the outcome of the decision at step 308 as the apparatus is operated in real time, the predicted number of rotations before the area is available for re-imaging may change. Different models may be invoked, or in effect selected by the larger scheduling system associated with the apparatus, to address different types of test patches as they are scheduled for various purposes.

Also shown in FIG. 3 is a box 320 representing the larger control system for invoking various tests at various times. The co-pending patent application being filed herewith, cited above, describes an overall system for scheduling the creation of test patches in interdocument zones or gaps between areas of the photoreceptor assigned, in a moving time-frame, for images scheduled to be printed. In brief, within the time-frame as images are scheduled to be printed, gaps suitable for printing of test patches are identified, taking into account multiple rotations of the photoreceptor required to erase the test patch. In an embodiment of the present disclosure, the predicted number of rotations of the photoreceptor for erasing a test patch is entered into the algorithm for identifying suitable gaps, as described in the application incorporated by reference. In the context of the co-pending application, the predicted number of required rotations would be entered as the variable ROTATIONS in the illustrated flow-chart.

While the present disclosure is directed to a monochrome, xerographic printing apparatus, the teachings and claims herein can be readily applied to color printing apparatus, and to any rotatable imaging member such as an intermediate belt or drum as used in xerography, iconography, production ink-jet, or offset printing.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A method of operating a printing apparatus, the apparatus having a rotatable imaging member, an imaging station useful in creating printable images and test patches with marking material on the rotatable imaging member, a cleaning station for removing marking material from the imaging member, and a sensor for measuring a density of marking material on a test patch, comprising:

creating a test patch in a predetermined area of the imaging member;

measuring a density of the test patch at least a first time, corresponding to a first rotation of the imaging member;

based at least partially on the measuring of the density of the test patch at least a first time, predicting how many rotations in the future the predetermined area of the imaging member will be available for receiving new marking material; and re-imaging in the predetermined area of the imaging member following the predicted number of rotations.

2. The method of claim 1, further comprising measuring a density of the test patch a second time, corresponding to a second rotation of the imaging member; and wherein the predicting is based at least partially on reading the density of the test patch a second time.

3. The method of claim 1, further comprising based on the measuring of the density of the test patch at least a first time and a second time, changing a prediction of how many rotations in the future the predetermined area of the imaging member will be available for receiving new marking material.

4. The method of claim 1, further comprising for a selected type of test patch, scheduling a predetermined number of rotations for effectively erasing the test patch; and based at least partially on the measuring of the density of the test patch at least a first time, reducing the scheduled number of rotations for effectively erasing the test patch.

5. The method of claim 1, further comprising selecting a prediction model for predicting how many rotations in the future the predetermined area of the imaging member will be available for re-imaging.

6. The method of claim 5, wherein the selecting of the prediction model is a result of scheduling of a type of test patch.

7. The method of claim 5, wherein the selecting of the prediction model depends at least partially on a type of marking material used to create the test patch.

8. The method of claim 5, wherein the selecting of the prediction model depends at least partially on an original intended density of the test patch.

9. The method of claim 1, wherein the rotatable imaging member is a photoreceptor.

10. A method of operating a printing apparatus, the apparatus having a rotatable imaging member, an imaging station useful in creating printable images and test patches with marking material on the rotatable imaging member, a cleaning station for removing marking material from the imaging member, and a sensor for measuring a density of marking material on a test patch, comprising:

creating a test patch in a predetermined area of the imaging member;

for a selected type of test patch, scheduling a predetermined number of rotations for effectively erasing the test patch;

measuring a density of the test patch at least a first time, corresponding to a first rotation of the imaging member; and based at least partially on the measuring of the density of the test patch at least a first time, reducing the scheduled number of rotations for effectively erasing the test patch; and re-imaging in the predetermined area of the imaging member following the reduced scheduled number of rotations.

11. The method of claim 10, further comprising measuring a density of the test patch a second time, corresponding to a second rotation of the imaging member; and wherein the reducing is based at least partially on reading the density of the test patch a second time.

12. The method of claim 10, further comprising for a selected type of test patch, selecting a prediction model for scheduling the predetermined number of rotations for effectively erasing the test patch.

13. The method of claim 12, wherein the selecting of the prediction model depends at least partially on a type of marking material used to create the test patch.

14. The method of claim 12, wherein the selecting of the prediction model depends at least partially on an original intended density of the test patch.

15. The method of claim 10, wherein the rotatable imaging member is a photoreceptor.

* * * * *